US009879690B2

(12) United States Patent
Griffin

(10) Patent No.: US 9,879,690 B2
(45) Date of Patent: Jan. 30, 2018

(54) COMPRESSOR HAVING HOLLOW SHAFT

(71) Applicants: DRESSER-RAND COMPANY, Olean, NY (US); Daniel J. Griffin, Enfield, CT (US)

(72) Inventor: Daniel J. Griffin, Enfield, CT (US)

(73) Assignee: Dresser-Rand Company, Olean, NY (US)

( * ) Notice: Subject to any disclaimer, the term of this patent is extended or adjusted under 35 U.S.C. 154(b) by 184 days.

(21) Appl. No.: 14/893,144

(22) PCT Filed: Jun. 2, 2014

(86) PCT No.: PCT/US2014/040437
§ 371 (c)(1),
(2) Date: Nov. 23, 2015

(87) PCT Pub. No.: WO2014/197343
PCT Pub. Date: Dec. 11, 2014

(65) Prior Publication Data

US 2016/0123344 A1 May 5, 2016

Related U.S. Application Data

(60) Provisional application No. 61/831,655, filed on Jun. 6, 2013.

(51) Int. Cl.
*F04D 29/051* (2006.01)
*F04D 29/18* (2006.01)
(Continued)

(52) U.S. Cl.
CPC ..... *F04D 29/181* (2013.01); *F04D 3/00* (2013.01); *F04D 7/00* (2013.01); *F04D 13/04* (2013.01); *F04D 17/122* (2013.01); *F04D 29/053* (2013.01); *F04D 29/054* (2013.01); *F04D 29/0516* (2013.01); *F04D 29/102* (2013.01)

(58) Field of Classification Search
CPC .. F04D 29/051; F04D 29/0516; F04D 29/102; F04D 29/041; F04D 29/0416; F04D 29/053; F04D 29/054; F04D 17/122; F04D 7/04; F04D 7/06; F05B 2240/60; F05B 2240/61; F01D 5/084; F01D 5/085; F01D 5/087
USPC ..... 415/104, 106, 107, 180, 216.1; 416/244 R, 244 A; 464/7, 179, 183
See application file for complete search history.

(56) References Cited

U.S. PATENT DOCUMENTS

2005/0118025 A1* 6/2005 Hiegemann ..... F01D 5/063 416/97 R
2007/0257444 A1* 11/2007 Childs ..... F16J 15/444 277/412
(Continued)

*Primary Examiner* — Christopher Verdier

(57) ABSTRACT

A shaft of a compressor may include a first shaft section defining a first cavity axially extending therein and a second shaft section defining a second cavity axially extending therein. A plurality of inlet holes may be defined on an outer surface of the first shaft section, and a plurality of outlet holes may be defined on an outer surface of the second shaft section. The plurality of inlet holes may be in fluid communication with the first cavity and the plurality of outlet holes may be in fluid communication with the second cavity. The first cavity and the second cavity may form a passageway fluidly coupling the plurality of inlet holes and the plurality of outlet holes.

12 Claims, 5 Drawing Sheets

(51) Int. Cl.

| | |
|---|---|
| ***F04D 29/054*** | (2006.01) |
| ***F04D 29/053*** | (2006.01) |
| ***F04D 29/10*** | (2006.01) |
| ***F04D 17/12*** | (2006.01) |
| ***F04D 3/00*** | (2006.01) |
| ***F04D 7/00*** | (2006.01) |
| ***F04D 13/04*** | (2006.01) |

(56) References Cited

U.S. PATENT DOCUMENTS

2008/0166222 A1* 7/2008 Yamashita ..... F01D 5/026
415/116
2009/0185895 A1* 7/2009 Wieghardt ..... F01D 3/04
415/104
2010/0034646 A1* 2/2010 Magara ..... F16J 15/4472
415/173.5
2012/0164005 A1* 6/2012 Alban ..... F04D 29/054
417/348
2012/0210722 A1* 8/2012 Hynum ..... F01D 5/081
60/772

* cited by examiner

COMPRESSOR HAVING HOLLOW SHAFT

CROSS-REFERENCE TO RELATED APPLICATIONS

This application claims priority to PCT Patent Application Ser. No. PCT/US2014/040437, filed on Jun. 2, 2014 and U.S. Provisional Patent Application Ser. No. 61/831,655, filed on Jun. 6, 2013. These priority applications are hereby incorporated by reference in their entirety into the present application to the extent consistent with the present application.

BACKGROUND

Compressors, for example, centrifugal compressors, operate to increase a pressure of a compressible working fluid, e.g., process gas. The process gas is received via one or more inlets at an input end of the compressor and passes through one or more impellers disposed in series on a rotatable cylindrical shaft. The shaft and the impellers may be driven by one or more motors coupled to the shaft. The pressure of the process gas increases as the process gas passes from one impeller to the next until the process gas reaches the final impeller. The compressed process gas is then expelled from the compressor via one or more outlets located at a discharge end of the compressor at a pressure greater than the pressure at which the process gas was input to the compressor.

FIG. 1 illustrates a cross-sectional view of a conventional compressor. The conventional compressor 100 includes a motor 102 (or any type of driver typically used for rotating compressors) coupled to a shaft 104. The motor 102 and/or the compressor 100 may be positioned within a housing 106. The housing 106 will generally hermetically-seal the motor 102 and the compressor 100 therein, thus providing support and protection for each component of the compressor 100. The shaft 104 may be supported at or proximate each end by at least one radial bearing, such as first and second radial bearings 108 and 110, and, depending on a length of the shaft, at one or more locations between the ends of the shaft. As shown in FIG. 1, the compressor 100 may be a multi-stage centrifugal compressor with a plurality of compressor stage impellers 112 disposed in series between the ends of the shaft 104. The compressor 100 receives process gas to be compressed from an inlet 116 (more than one inlet may be present), compresses the process gas through the successive stages of impellers 112, and thereby produces a compressed process gas. The compressed process gas exits the compressor 100 via an outlet 118 (more than one outlet may be present). The process gas, typically, includes acid gas, e.g., natural gas or any other gas mixture containing significant quantities of hydrogen sulfide ($H_2S$), carbon dioxide ($CO_2$), or similar acidic gases.

A balance piston 114, including an accompanying balance piston seal (not shown), may be arranged on the shaft 104 between the motor 102 and the compressor 100. The balance piston 114 is typically located behind the final impeller 112 and the backside (for example, the side of the balance piston 114 facing the motor 102 in FIG. 1) of the balance piston 114 is vented to the compressor input end via a balance line 120. As a result, any compressed process gas flowing across the balance piston seal/balance piston (also referred to as balance piston leakage) may be returned to the input end via the balance line 120 to be recompressed.

The National Association of Corrosion Engineers (NACE) Standards specify, among other things, the proper materials required to provide good service life of machinery used in acid gas environments. A NACE compliant material or component is substantially resistant to corrosion, such as the type that may occur upon exposure of a non-NACE compliant material to acid gas. Typically, materials that are exposed to the acid gas, e.g., the balance line, drillings (holes) in the compressor head and case, and other external pipes handling the acid gas, etc., are protected using NACE compliant claddings or protective sleeves.

The balance line and other external pipes that return the balance piston leakage tend to be large in size given the relatively high flow rate of the balance piston leakage passing through them and thus occupy considerable space. Also, the drillings in the compressor head typically are compound drillings (e.g., several holes in different directions) and installing claddings or protective sleeves on these compound drillings is difficult.

What is then needed is a relatively convenient method for returning the balance piston leakage to the input end of the compressor without using external plumbing or large complex drilled passages in the compressor heads or casing.

SUMMARY

Example embodiments of the disclosure provide a compressor. The compressor may include an inlet at an input end of the compressor and an outlet at a discharge end of the compressor. The inlet may be configured to receive a working fluid and the outlet may be configured to expel the working fluid having a greater pressure. The input end and the discharge end may be axially separated. The compressor may also include a rotatable shaft extending axially between the input end and the discharge end, an impeller mounted about the rotatable shaft between the inlet and the outlet, a balance piston mounted about the rotatable shaft and disposed immediately following the impeller from the input end, and a balance piston seal mounted about the balance piston. The rotatable shaft may define a passageway fluidly coupling the inlet and the outlet. The passageway may be configured to receive at least a portion of the working fluid flowing across the balance piston seal and to supply the portion of the working fluid to the input end.

Example embodiments of the disclosure may also provide a shaft of a compressor. The shaft may include a first shaft section defining a first cavity axially extending therein and a plurality of inlet holes on an outer surface of the first shaft section, and a second shaft section defining a second cavity axially extending therein and a plurality of outlet holes on an outer surface of the second shaft section. The plurality of inlet holes may be in fluid communication with the first cavity and the plurality of outlet holes may be in fluid communication with the second cavity. The first cavity and the second cavity may form a passageway fluidly coupling the plurality of inlet holes and the plurality of outlet holes.

Example embodiments of the disclosure may further provide a compressor. The compressor may include an inlet at an input end of the compressor, an outlet at a discharge end of the compressor, and a rotatable shaft extending axially between the inlet and the outlet. The inlet may be configured to receive a working fluid and the outlet may be configured to expel the working fluid having a greater pressure. The rotatable shaft may define a passageway fluidly coupling the inlet and the outlet. The input end and the discharge end may be axially separated. The compressor may also include an impeller mounted about the rotatable shaft between the inlet and the outlet, a balance piston mounted about the rotatable shaft and disposed immediately following the impeller from the input end, and a balance piston seal mounted about the balance piston. The rotatable shaft may include a first shaft section and a second shaft section. The first shaft section may define a first cavity and a plurality of inlet holes on an outer surface of the first shaft section. The plurality of inlet holes may be in fluid communication with the first cavity. The second shaft section may define a second cavity and a plurality of outlet holes on an outer surface of the second shaft section. The plurality of outlet holes may be in fluid communication with the second cavity. The first cavity and the second cavity may form the passageway.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
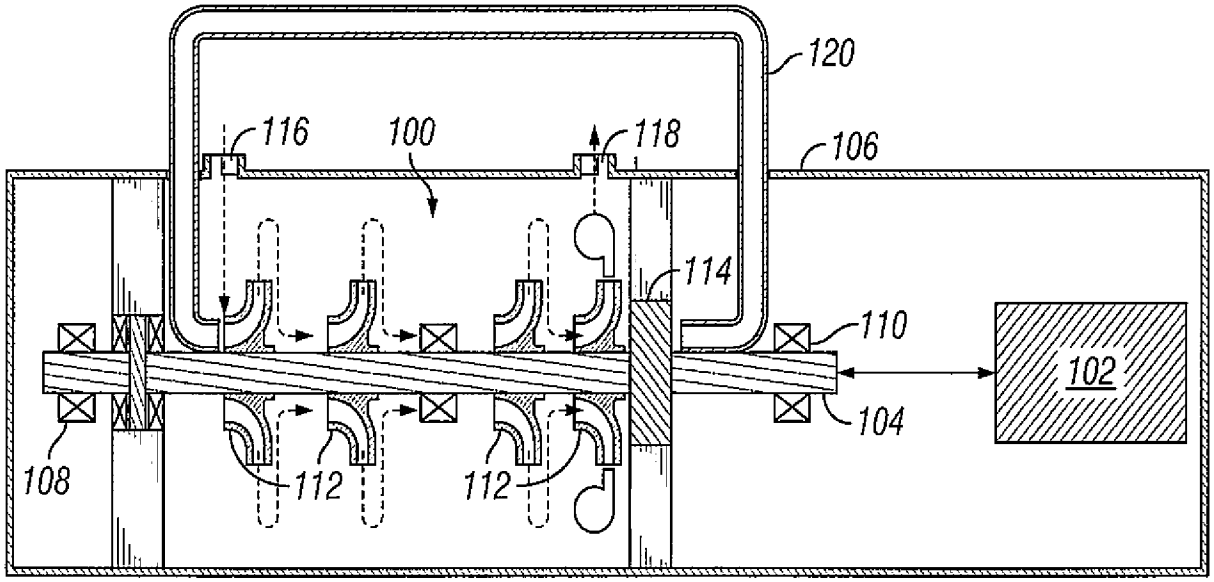
FIG. 1 (Prior Art)
FIG. 1 illustrates a cross-sectional view of a conventional compressor.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Figure 2:
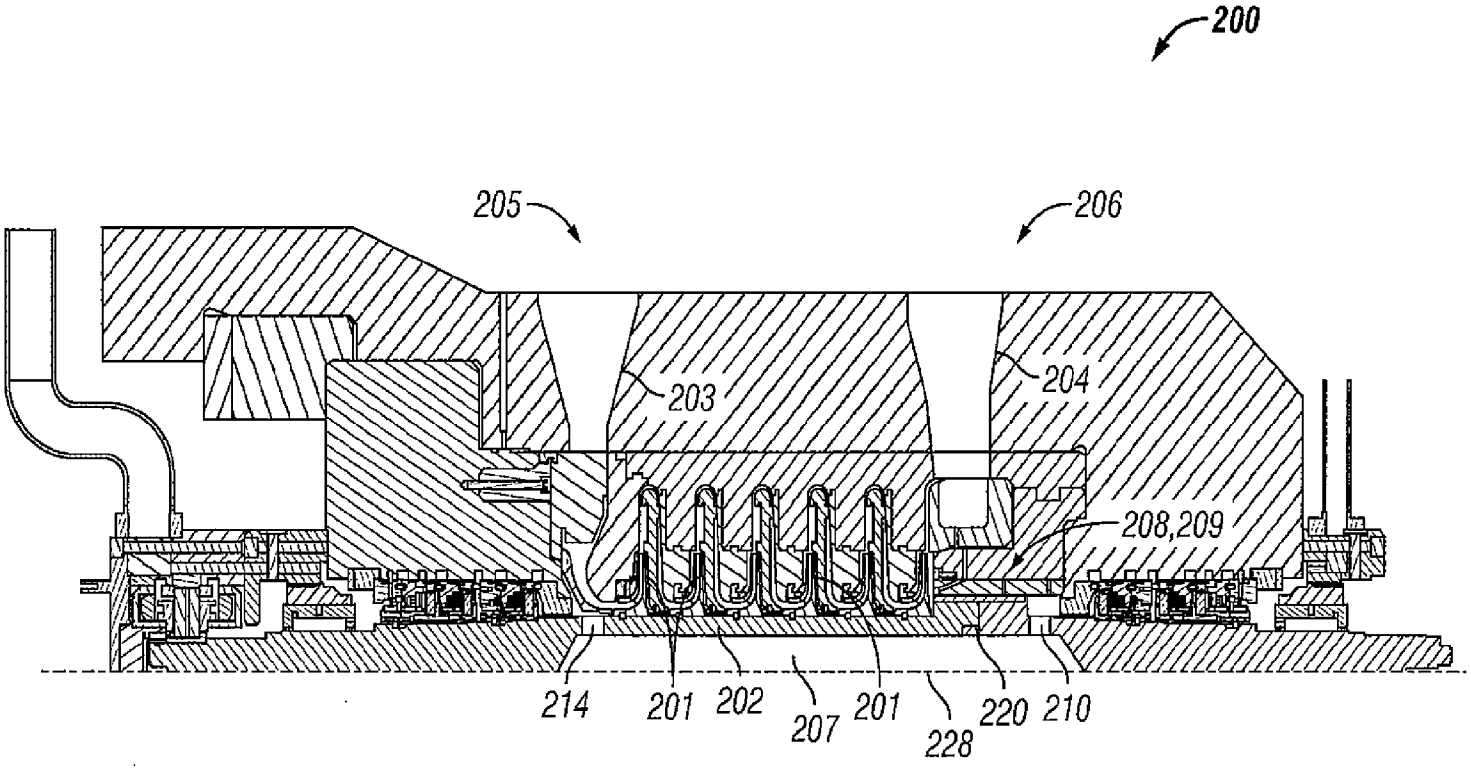
FIG. 2 illustrates a partial cross-sectional view of a compressor including an inlet end, a discharge end, and a hollow shaft, according to one or more example embodiments.

FIG. 2 illustrates a partial cross-sectional view of a compressor 200 including a hollow shaft 202 configured to be rotatable therein, according to one or more example embodiments. The compressor 200 may include a plurality of impellers 201 axially mounted on the hollow shaft 202. A process gas to be compressed may be provided (e.g., directly fed) to the first impeller 201 via an inlet 203 (a plurality of inlets 203 may be present) at an input end 205 of the compressor 200 and the process gas may be compressed through the successive stages of impellers 201. The compressed process gas may then exit the compressor 200 via an outlet 204 (a plurality of outlets 204 may be present) at a discharge or output end 206 of the compressor 200. The hollow shaft 202 may define a passageway 207 that may extend axially between the inlet 203 and the outlet 204. As illustrated in FIG. 2, a balance piston 208 including an accompanying balance piston seal 209 may be mounted on the hollow shaft 202 after the last impeller 201 (counted from the inlet 203 to the outlet 204). The compressed process gas that may flow across the balance piston 208/balance piston seal 209 (referred to as the balance piston leakage) may be returned to the input end 205 via the passageway 207 defined by the hollow shaft 202. The returned balance piston leakage may be combined with the process gas entering the compressor 200 via the inlet 203 and may thus be provided to the first impeller 201 along with the process gas. The surface of the passageway 207 may be machined finished to provide a relatively smooth passage for the balance piston leakage.

Figure 3:
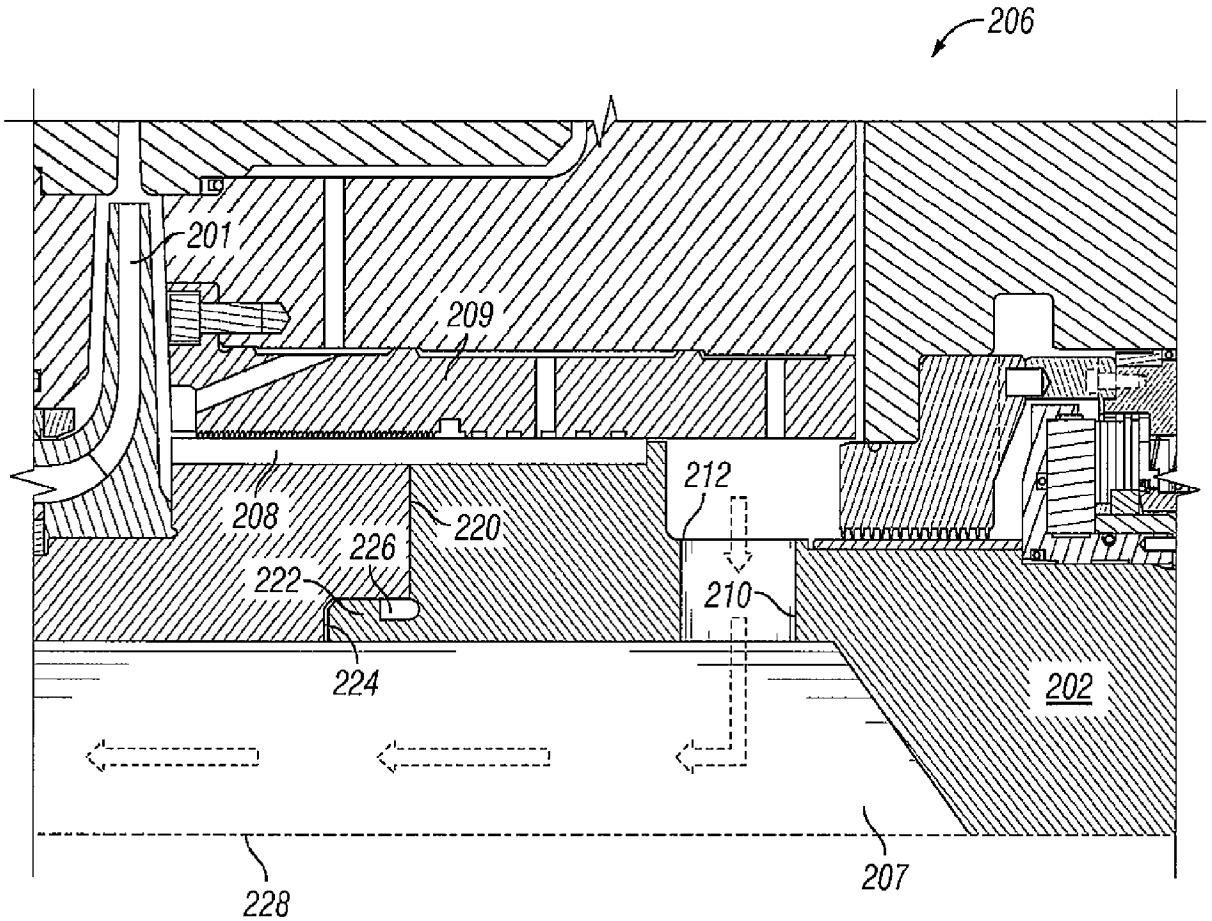
FIG. 3 illustrates an enlarged cross-sectional view of the discharge end of the compressor of FIG. 2, according to one or more example embodiments.

FIG. 3 illustrated a more detailed cross-sectional view of the discharge end 206 of the compressor 200 in FIG. 2, according to one or more example embodiments. The balance piston leakage may enter the hollow shaft 202 via a plurality of inlet holes 210 located circumferentially about the outer surface 212 of the hollow shaft 202 at or adjacent the discharge end 206 of the compressor 200. The plurality of inlet holes may extend radially inward from the outer surface 212 of the hollow shaft 202 and may be in fluid communication with the passageway 207. Due to a difference in pressure between the discharge end 206 and the input end 205 of the compressor 200, the balance piston leakage may travel towards the input end 205 via the passageway 207 with relative ease. A general flowpath of the balance piston leakage is illustrated by block arrows in FIG. 3.

Figure 4:
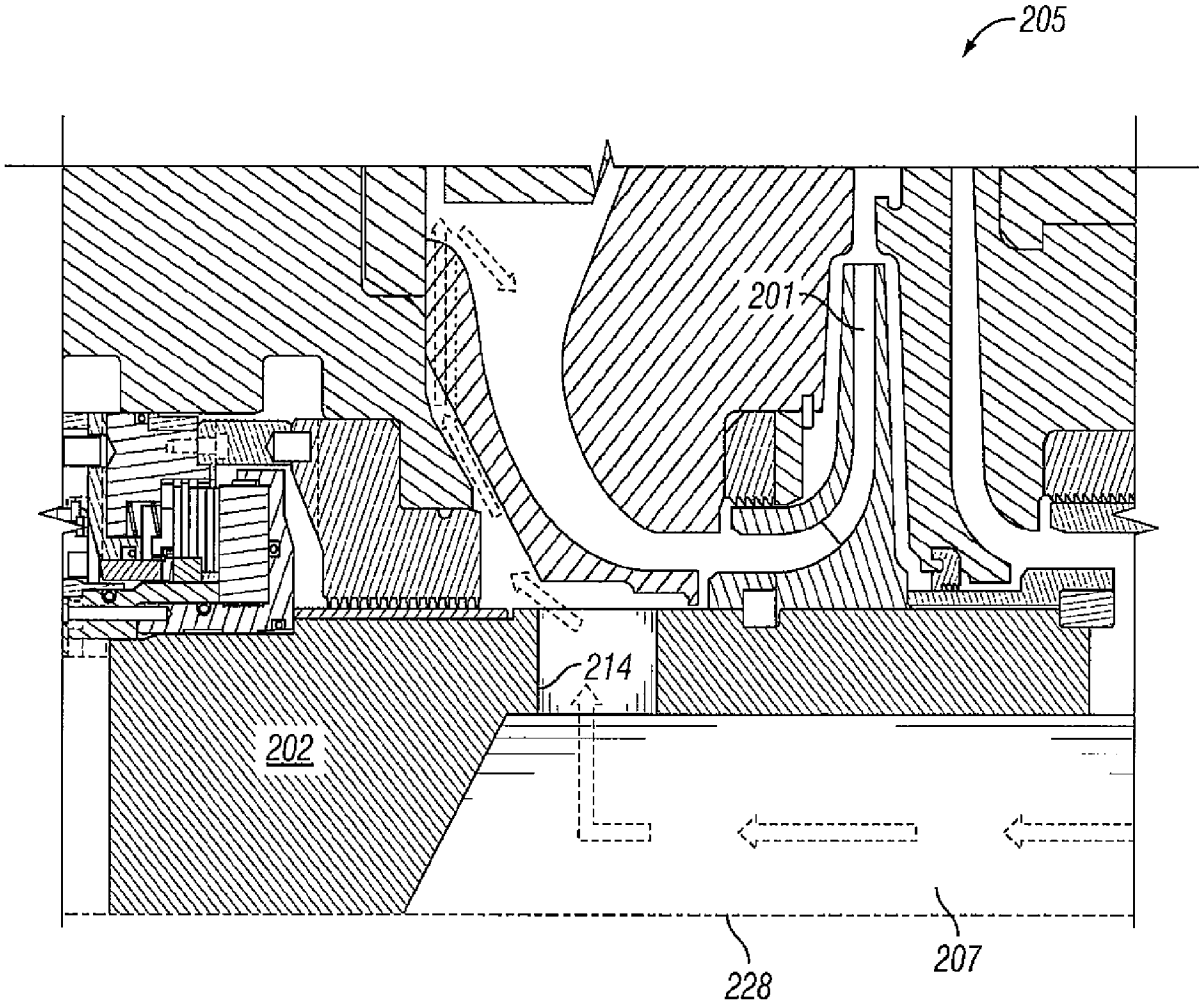
FIG. 4 illustrates an enlarged cross-sectional view of the input end of the compressor of FIG. 2, according to one or more example embodiments.

FIG. 4 illustrates a more detailed cross-sectional view of the input end 205 of the compressor 200 in FIG. 2, according to one or more example embodiments. The balance piston leakage entering the hollow shaft 202 from the discharge end 206 may exit the hollow shaft 202 via a plurality of outlet holes 214 located circumferentially about the outer surface 212 of the hollow shaft 202 at or adjacent the input end 205 of the compressor 200. The plurality of outlet holes 214 may extend radially inward from the outer surface 212 of the hollow shaft 202 and may be in fluid communication with the passageway 207. The plurality of outlet holes 214 may be located such that the balance piston leakage exiting the hollow shaft 202 may be combined with the process gas entering the compressor 200 via the inlet 203. A general flowpath of the balance piston leakage is illustrated by block arrows in FIG. 4.

Figure 5:
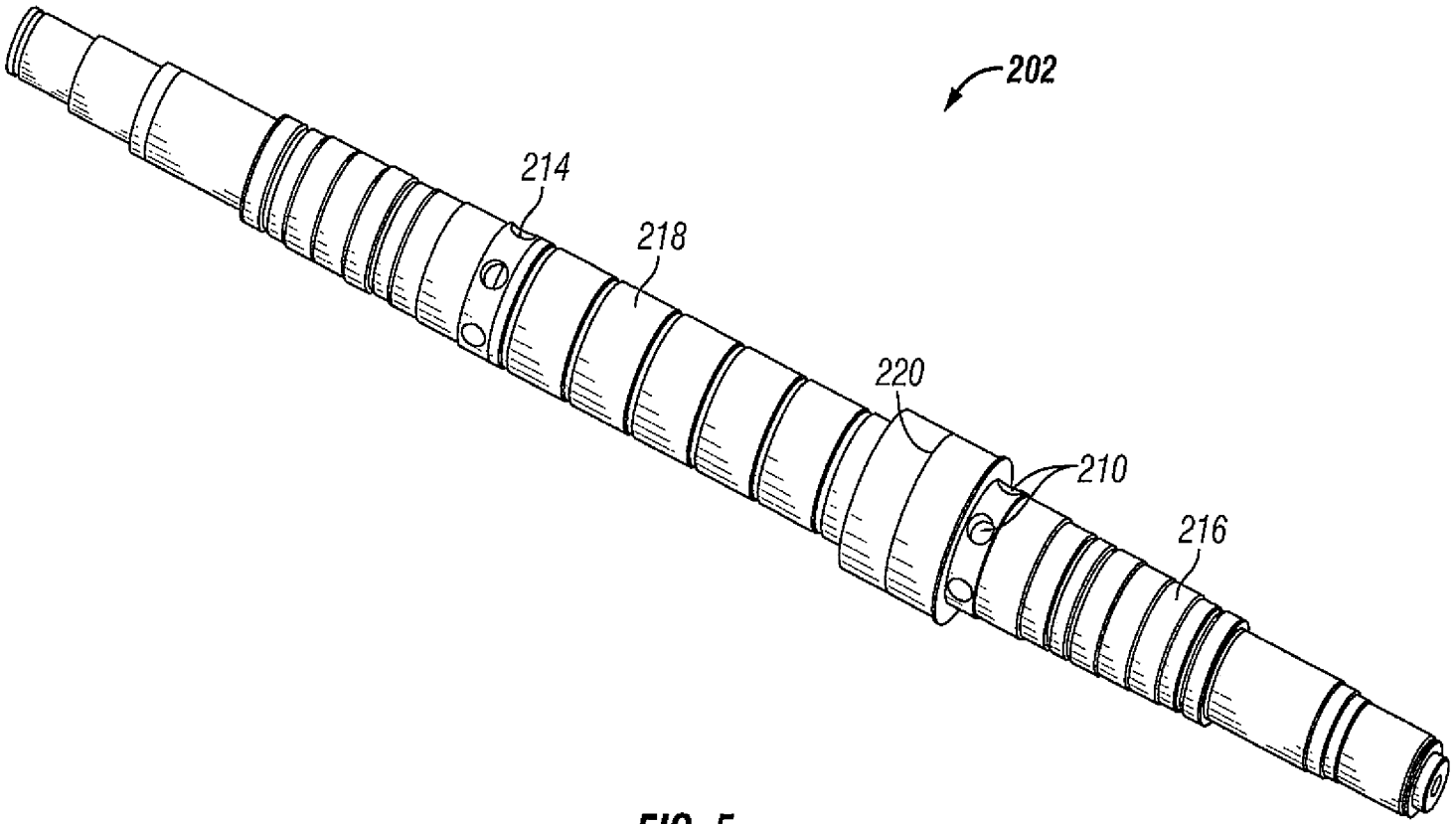
FIG. 5 illustrates a perspective view of the hollow shaft of the compressor of FIG. 2, according to one or more example embodiments.

FIG. 5 illustrates a perspective view of the hollow shaft 202 of the compressor 200 in FIGS. 2-4, according to one or more example embodiments. The hollow shaft 202 may include a first shaft section 216 and a second shaft section 218 that may be coupled together. For example, the first shaft section 216 and the second shaft section 218 may be coupled via laser welding, electron beam welding, friction welding, inertia welding, or the like. The first shaft section 216 and the second shaft section 218 may each define a portion of the passageway 207 therein. As illustrated in FIG. 5, the plurality of outlet holes 214 may be defined by the second shaft section 218 and the plurality of inlet holes 210 may be defined by the first shaft section 216. In an example embodiment, the first shaft section 216 and the second shaft section 218 may be coupled such that, when the hollow shaft 202 is installed in the compressor 200, a joint 220 between the first shaft section 216 and the second shaft section 218 may be at or adjacent the balance piston 208 (See FIG. 3). For example, as illustrated in FIG. 3, the joint 220 may be located beneath the balance piston 208. It should be noted that the location of the joint 220 is a design choice and the joint 220 may be located anywhere along the hollow shaft 202 to fit a number of applications without departing from the scope of the present disclosure.

As illustrated in FIG. 3, the first shaft section 216 may form or at least include a protrusion 222 (also referred to as an inner pilot) that may be received or seated in a corresponding depression or slot 224 defined in the second shaft section 218. The protrusion 222 and the depression 224 may be configured to aligning the first shaft section 216 and the second shaft section 218 prior to coupling the first shaft section 216 and the second shaft section 218. The first shaft section 216 and the second shaft section 218 may be aligned such that the passageway 207 may have a substantially constant diameter at least between the plurality of inlet holes 210 and the plurality of outlet holes 214. Although the protrusion 222 is disclosed as being formed on the first shaft section 216, the protrusion 222 may also be formed on the second shaft section 218 and, similarly, the depression 224 may also be defined on the first shaft section 216.

The protrusion 222 may also define a cavity 226 that may be configured to collect debris (e.g., weld splatter generated when welding the first shaft section 216 and the second shaft section 218) produced when coupling the first shaft section 216 and the second shaft section 218 together, thereby preventing the debris from entering the passageway 207. The outer cylindrical surface 212 of the hollow shaft 202 may be finish grinded so as to create a relatively smooth outer cylindrical surface 212. It should be noted that the size and shape of the inlet and outlet holes and the inside diameter of the passageway may be variable and may depend, e.g., on frame size of the compressor, impeller bore size, flow requirements of the compressor, and/or any space restrictions. The plurality of inlet holes 210 and the plurality of outlet holes 214 may be disposed at a same radial distance from the axis of rotation 228 of the hollow shaft 202. In an example embodiment, a number of outlet holes 214 may be the same as a number of inlet holes 210.

Example embodiments disclosed above may provide numerous advantages over the existing designs. The hollow shaft 202 is beneficial in compressors that need large balance return plumbing. The hollow shaft 202 may reduce the need for such plumbing, thereby freeing up valuable space on heads and casings. As a result, the compressor heads may also be reduced in size. The hollow shaft 202 may result in improved rotor dynamics. For example, the hollow shaft 202 may be rotor dynamic neutral in that the loss in the shaft stiffness (as a result of being hollow) is offset by the loss in the rotor mass. Also, a reduction in the external plumbing and improved rotor dynamics may result in cost savings.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

I claim:

1. A compressor, comprising:

an inlet at an input end of the compressor, the inlet configured to receive a working fluid at a first pressure;

an outlet at a discharge end of the compressor, the outlet configured to expel the working fluid having a second pressure greater than the first pressure, the input end and the discharge end being axially separated;

a rotatable shaft extending axially between the input end and the discharge end, the rotatable shaft having respective first and second shaft sections, rigidly coupled to each other along a shaft coupling joint, and defining a common passageway fluidly coupling the inlet and the outlet, wherein one of the first or second shaft sections includes a protrusion and the other of the first or second shaft sections defines a corresponding depression configured to receive or seat the protrusion, the protrusion and the corresponding depression configured to align the respective first and second shaft sections coaxially with each other along the shaft coupling joint;

an impeller mounted about the rotatable shaft between the inlet and the outlet;

a balance piston mounted about the rotatable shaft, axially and radially circumscribing the first and second shaft sections over the shaft coupling joint and the respective protrusion and depression, and disposed immediately following the impeller from the input end; and a balance piston seal mounted about the balance piston, wherein the passageway is configured to receive at least a portion of the working fluid flowing across the balance piston seal and to supply the portion of the working fluid to the input end.

2. The compressor of claim 1, wherein the rotatable shaft defines a plurality of inlet holes and a plurality of outlet holes, such that the plurality of inlet holes are circumferentially disposed about the rotatable shaft at or adjacent the discharge end and the plurality of outlet holes are circumferentially disposed about the rotatable shaft at or adjacent the input end, the plurality of inlet holes and the plurality of outlet holes being in fluid communication with the passageway, the inlet, and the outlet.

3. The compressor of claim 2, wherein the plurality of inlet holes are defined on one of the respective first shaft or second shaft sections and the plurality of outlet holes are defined on the other of the first or second shaft sections.

4. The compressor of claim 2, wherein the plurality of inlet holes and the plurality of outlet holes are at a same radial distance from the axis of rotation of the rotatable shaft.

5. The compressor of claim 2, wherein the plurality of outlet holes are disposed such that the portion of the working fluid exiting the passageway combines with the received working fluid.

6. The compressor of claim 1, wherein the first shaft section and the second shaft section are coupled along the shaft coupling joint by laser welding, or electron beam welding, or friction welding, or inertia welding.

7. The compressor of claim 6, wherein the shaft coupling joint is oriented radially inboard of the balance piston and radially outboard of the protrusion, and wherein the protrusion defines a cavity in communication with the shaft coupling joint but isolated from the passageway, the cavity configured to collect debris generated during welding of the first and second shaft sections and prevent the debris from entering the passageway.

8. A shaft of a compressor, comprising:

a first shaft section defining a first cavity axially extending therein and a plurality of inlet holes on an outer surface of the first shaft section, the plurality of inlet holes being in fluid communication with the first cavity;

a second shaft section defining a second cavity axially extending therein and a plurality of outlet holes on an outer surface of the second shaft section, the plurality of outlet holes being in fluid communication with the second cavity, the first cavity and the second cavity forming a passageway fluidly coupling the plurality of inlet holes and the plurality of outlet holes;

the respective first and second shaft sections rigidly coupled to each other along a shaft coupling joint, wherein one of the first or second shaft sections includes a protrusion and the other of the first or second shaft sections defines a corresponding depression configured to receive or seat the protrusion, the protrusion and the corresponding depression configured to align the respective first and second shaft sections coaxially with each other along an axis of rotation of the shaft and along the shaft coupling joint;

a centrifugal compressor impeller mounted about the second shaft section between the inlet holes and the outlet holes, the impeller having a front face for compressing a working fluid when the first and second shaft sections are coupled to and driven by a motor and an opposing back face;

a balance piston axially and radially circumscribing the first and second shaft sections over the shaft coupling joint and the respective protrusion and depression, and disposed axially adjacent the back face of the impeller.

9. The shaft of claim 8, wherein the first shaft section and the second shaft section are coupled along the shaft coupling joint by laser welding, or electron beam welding, or friction welding, or inertia welding.

10. The shaft of claim 9, wherein the shaft coupling joint is oriented radially inboard of the balance piston and radially outboard of the protrusion, and wherein the protrusion defines a cavity in communication with the shaft coupling joint but isolated from the passageway, the cavity configured to collect debris generated during welding of the first and second shaft sections and prevent the debris from entering the passageway.

11. The shaft of claim 8, wherein the passageway has a substantially constant diameter between the plurality of inlet holes and the plurality of outlet holes.

12. The shaft of claim 8, wherein the plurality of inlet holes and the plurality of outlet holes are at a same radial distance from the axis of rotation of the shaft.

* * * * *